US007701158B2

(12) United States Patent
Wu et al.

(10) Patent No.: US 7,701,158 B2
(45) Date of Patent: Apr. 20, 2010

(54) FAN SYSTEM AND SPEED DETECTING DEVICE THEREOF

(75) Inventors: Chia-Feng Wu, Taoyuan Hsien (TW); Cheng-Chieh Liu, Taoyuan Hsien (TW); Ching-Sen Hsieh, Taoyuan Hsien (TW); Yueh-Lung Huang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 264 days.

(21) Appl. No.: 11/638,508

(22) Filed: Dec. 14, 2006

(65) Prior Publication Data

US 2007/0145920 A1 Jun. 28, 2007

(30) Foreign Application Priority Data

Dec. 23, 2005 (TW) ..... 94145981 A

(51) Int. Cl.
*H02P 7/00* (2006.01)

(52) U.S. Cl. ..... 318/268; 318/280; 318/400.1; 318/400.07; 318/400.12; 318/779

(58) Field of Classification Search ..... 318/268, 318/280, 400.01, 700, 55, 59, 115, 146, 163, 318/400.07, 400.12, 715, 721, 779, 823, 318/257, 369; 713/322; 340/63, 438, 571; 73/307, 488, 507, 514.31, 514.39
See application file for complete search history.

(56) References Cited

U.S. PATENT DOCUMENTS 4,034,335 A * 7/1977 Harazoe et al. ..... 123/397
4,479,115 A * 10/1984 Holzhauer ..... 340/611
4,499,377 A * 2/1985 Presser ..... 250/343
5,469,148 A * 11/1995 Baumann et al. ..... 340/658
5,534,854 A * 7/1996 Bradbury et al. ..... 340/648
5,548,969 A * 8/1996 Lee ..... 62/228.4
5,790,430 A * 8/1998 Steiert ..... 340/648
5,952,798 A * 9/1999 Jones et al. ..... 318/268
5,977,733 A * 11/1999 Chen ..... 318/434
6,009,362 A * 12/1999 Furukawa ..... 701/29
6,163,266 A * 12/2000 Fasullo et al. ..... 340/664
6,188,189 B1 * 2/2001 Blake ..... 318/471
6,271,609 B1 * 8/2001 Hollenbeck et al. ..... 310/71
6,380,704 B1 * 4/2002 Chin ..... 318/268
6,400,113 B1 * 6/2002 Garcia et al. ..... 318/463
6,545,438 B1 * 4/2003 Mays, II ..... 318/400.01
6,611,117 B1 * 8/2003 Hardt ..... 318/400.22
6,630,892 B1 * 10/2003 Crockford et al. ..... 340/904
6,725,132 B2 * 4/2004 Frankel et al. ..... 700/300
6,824,362 B2 * 11/2004 Dodson, III ..... 417/22

(Continued)

*Primary Examiner*—Bentsu Ro
*Assistant Examiner*—Antony M Paul
(74) *Attorney, Agent, or Firm*—Birch, Stewart, Kolasch & Birch, LLP

(57) ABSTRACT

A fan system includes a driving device, a speed detecting device and a logic device. The driving device generates a speed detecting signal and a predetermined alarm signal. The speed detecting device, which is electrically connected with the driving device, receives the speed detecting signal, and generates a low speed signal when the speed detecting signal is lower than a reference signal. The logic device is respectively electrically connected with the driving device and the speed detecting device, and generates an alarm signal when the logic device receives the predetermined alarm signal or the low speed signal.

17 Claims, 4 Drawing Sheets

U.S. PATENT DOCUMENTS 6,876,165 B1 * 4/2005 Rappenecker et al. .. 318/400.12
6,954,684 B2 * 10/2005 Frankel et al. ..... 700/300
7,038,408 B2 * 5/2006 Lin et al. ..... 318/268
7,075,446 B2 * 7/2006 Schondelmaier et al. .... 340/648
7,151,349 B1 * 12/2006 Williamson et al. .... 318/400.37
7,244,106 B2 * 7/2007 Kallman et al. ..... 417/44.1
2003/0091441 A1 * 5/2003 Huang et al. ..... 417/42

* cited by examiner

FAN SYSTEM AND SPEED DETECTING DEVICE THEREOF

CROSS REFERENCE TO RELATED APPLICATIONS

This Non-provisional application claims priority under 35 U.S.C. §119(a) on Patent Application No(s). 094145981 filed in Taiwan, Republic of China on Dec. 23, 2005, the entire contents of which are hereby incorporated by reference.

BACKGROUND OF THE INVENTION

1. Field of Invention

The invention relates to a fan system and a speed detecting device thereof, and, in particular, to a fan system with a low speed alarm function and a speed detecting device thereof.

2. Related Art

With the rapid development of the electronic device toward the high performance, high-frequency, high speed, low weight and small thickness, the temperature of the electronic device is getting higher and higher. Thus, the unstable phenomenon may occur and the product reliability is influenced. Accordingly, the heat dissipation has become one of the most important subjects in the present electronic device.

A fan system usually serves as a heat dissipating structure to keep the electronic device operating normally in the prior art. Referring to FIG. 1, a conventional fan system 10 mainly has a plurality of fans 11 and a plurality of drive chips 12. The fans 11 are connected in series according to the flowing direction of the air. The fans 11 may be connected in series by connecting the fan frames of the fans 11. When any fan 11 breaks down and stops (e.g., when an impeller of the fan 11 is blocked by an object), a corresponding drive chip 12 can detect the condition that the broken-down fan 11 stops rotating, and output a predetermined alarm signal RD (e.g., a high level voltage) to an electronic device 1 so as to alarm that the fan 11 has broken down. Thus, the broken-down fan 11 may be replaced or repaired.

However, because the fans 11 are connected in series, the broken-down fan 11 may rotate due to other fans. Thus, the drive chip 12 corresponding to the broken-down fan 11 cannot detect the broken-down condition and make a misjudgment such that the alarm signal RD cannot be outputted.

Therefore, it is an important subject to provide a fan system and a speed detecting device thereof capable of solving the above-mentioned problems.

SUMMARY OF THE INVENTION

In view of the foregoing, the invention is to provide a fan system and a speed detecting device thereof for generating an alarm signal to achieve the desired alarm function when the speed of the fan is too low.

To achieve the above, a fan system of the invention includes a drive device, a speed detecting device and a logic device. The drive device generates a speed detecting signal and a predetermined alarm signal. The speed detecting device, which is electrically connected with the drive device, receives the speed detecting signal and generates a low speed signal when the speed detecting signal is lower than a reference signal. The logic device, which is electrically connected with the drive device and the speed detecting device, generates an alarm signal when it receives the predetermined alarm signal or the low speed signal.

To achieve the above, the invention further discloses another fan system for receiving a speed detecting signal. The fan system includes a speed detecting device and a logic device. The speed detecting device receives the speed detecting signal and generates a low speed signal when the speed detecting signal is lower than a reference signal. The logic device, which is electrically connected with the drive device and the speed detecting device, generates an alarm signal when it receives the predetermined alarm signal or the low speed signal.

To achieve the above, the invention also discloses a speed detecting device of a fan system, which has a drive device for generating a speed detecting signal. The speed detecting device includes a signal processing unit and a comparing unit. The signal processing unit receives the speed detecting signal and generates a corresponding speed signal according to the speed detecting signal. The comparing unit, which is electrically connected with the signal processing unit, compares the speed signal with a reference signal, generates a low speed signal when the speed signal is lower than the reference signal, and thus generates an alarm signal.

To achieve the above, the invention further discloses another speed detecting device of a fan system for receiving a speed detecting signal. The speed detecting device includes a signal processing unit and a comparing unit. The signal processing unit receives the speed detecting signal and generates a corresponding speed signal according to the speed detecting signal. The comparing unit, which is electrically connected with the signal processing unit, compares the speed signal with a reference signal, generates a low speed signal when the speed signal is lower than the reference signal, and thus generates an alarm signal.

As mentioned above, the fan system and the speed detecting device thereof of the invention detect the speed of the fan and generate the alarm signal when the detected speed of the fan is too low, so as to prevent the broken-down fan from be driven by other fans, and to avoid the condition that the broken-down fan cannot be detected and the alarm signal cannot be outputted. Compared with the prior art, the invention detects the speed of the fan in order to detect the broken-down fan surely, and the desired alarm function can be achieved by the double confirmation.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
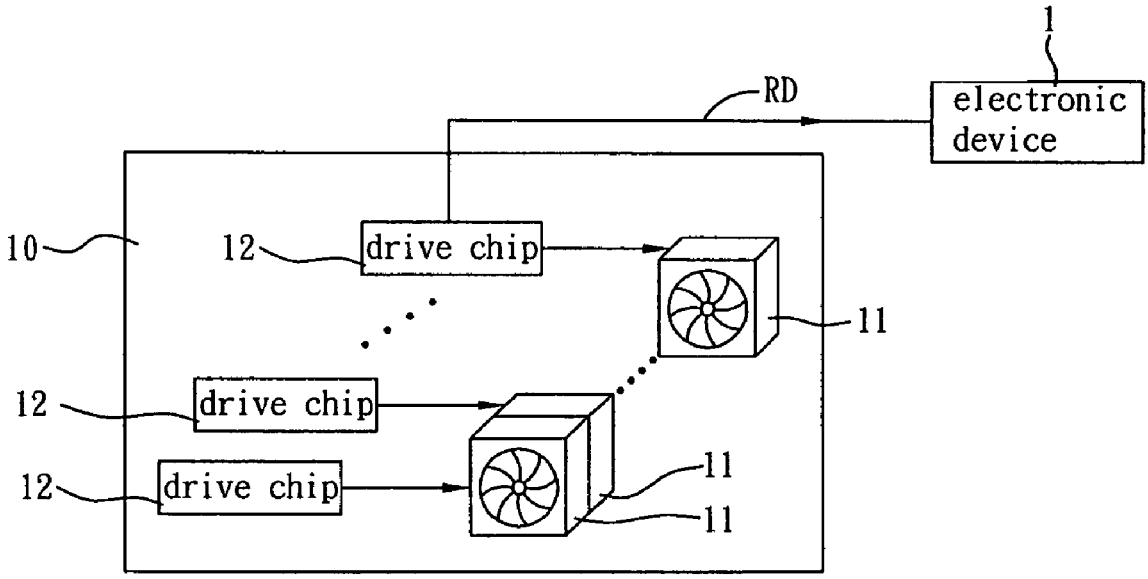
FIG. 1 (PRIOR ART)
FIG. 1 is a schematic illustration showing a conventional fan system.
Figure 2:
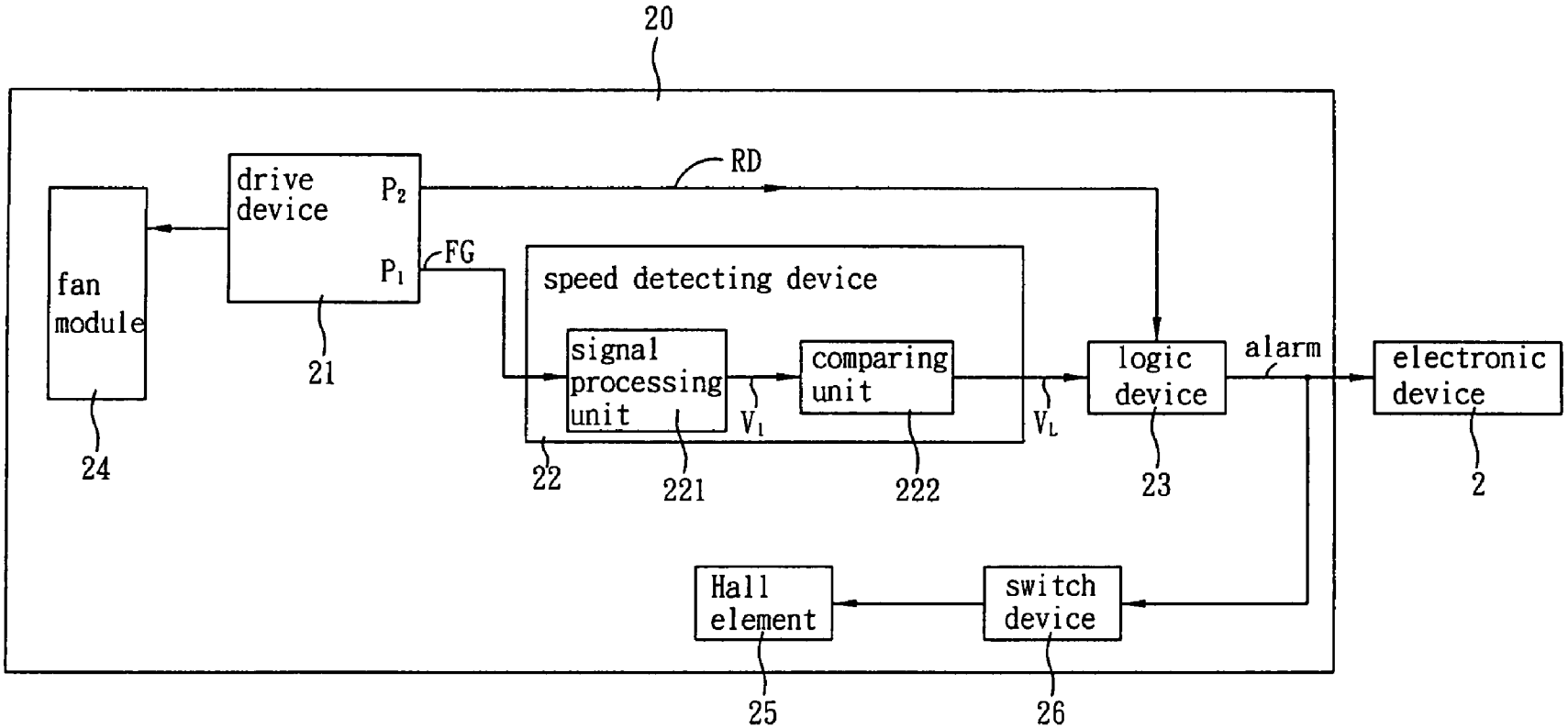
FIG. 2 is a schematic illustration showing a fan system according to a preferred embodiment of the invention.
Figure 3:
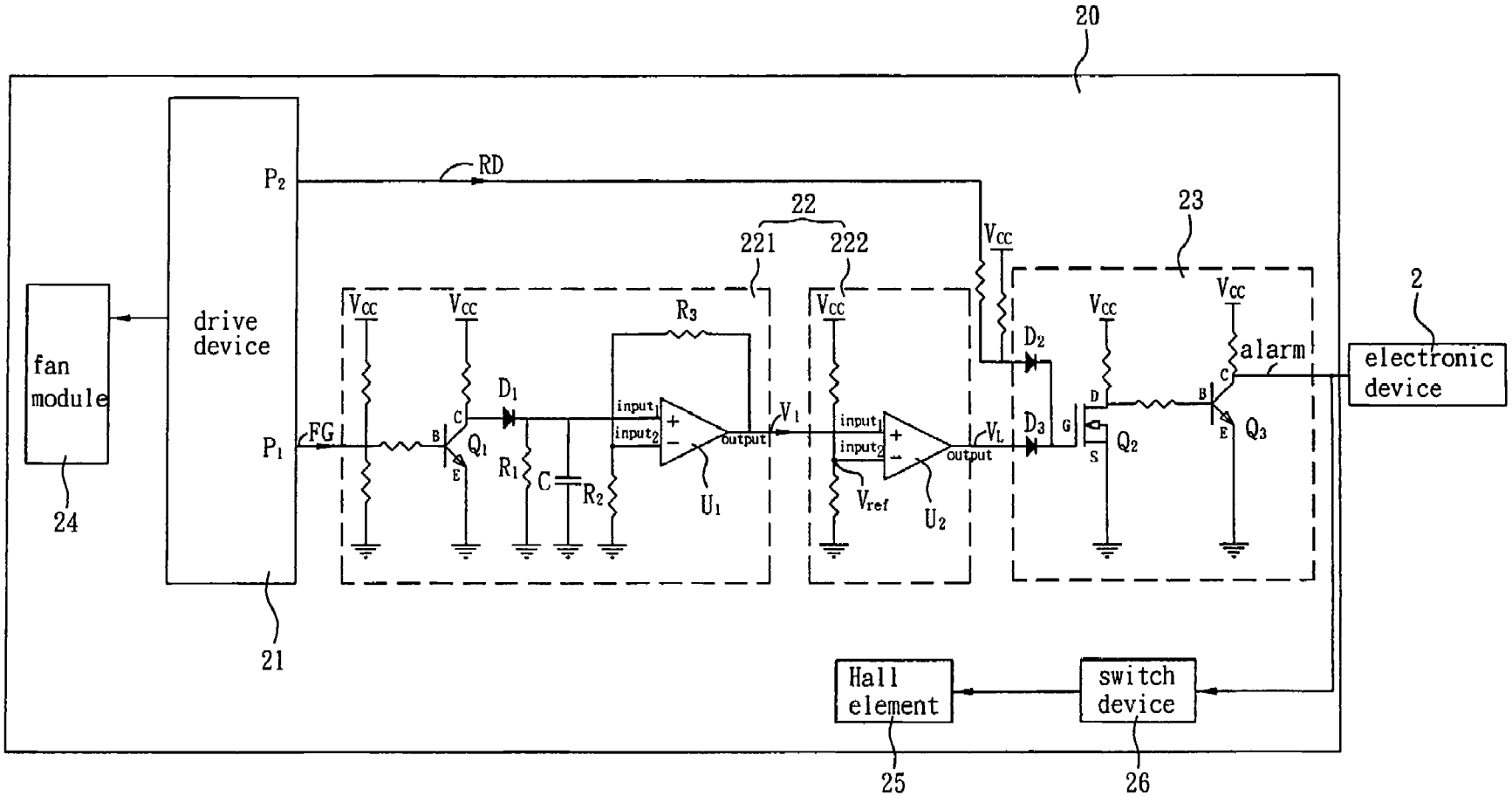
FIG. 3 is a circuit diagram showing the fan system according to the preferred embodiment of the invention.

FIGS. 2 and 3 are a schematic illustration and a circuit diagram respectively showing a fan system 20 according to a preferred embodiment of the invention. As shown in FIGS. 2 and 3, the fan system 20 may be used in conjunction with an electronic device 2. The fan system 20 includes a drive device 21, a speed detecting device 22, a logic device 23 and a fan module 24. The fan module 24 has at least one fan.

The drive device 21 may be a drive chip or a drive circuit and is electrically connected with the fan module 24 to control the speed of the fan module 24. In addition, the drive device 21 has a first signal terminal $P_1$ and a second signal terminal $P_2$. The first signal terminal $P_1$ outputs a speed detecting signal FG, and the second signal terminal $P_2$ outputs a predetermined alarm signal RD.

In this embodiment, the speed detecting signal FG is a pulse width modulation (PWM) signal. The higher frequency of the speed detecting signal FG represents the higher speed of the fan module 24. Although the speed detecting signal FG is provided by the drive device 21 in this embodiment, the signal FG may also be provided by a speed detecting element (not shown).

The predetermined alarm signal RD may be a high voltage level signal, which is a predetermined alarm signal inside the drive device 21. When the fan module 24 is damaged, the drive device 21 can detect the condition that the fan module 24 stops rotating, and thus output the predetermined alarm signal RD. The inside of the second signal terminal $P_2$ of the drive device 21 may be an open collector type circuit for generating the predetermined alarm signal RD.

The speed detecting device 22 includes a signal processing unit 221 and a comparing unit 222. The signal processing unit 221, which is electrically connected with the drive device 21, receives the speed detecting signal FG, and generates a corresponding speed signal $V_1$ for the subsequent circuit processing according to the speed detecting signal FG.

Referring to FIG. 3, the signal processing unit 221 includes a first switch element $Q_1$, at least one capacitor C, a diode $D_1$, an amplifier $U_1$ and a plurality of resistors $R_1$ to $R_3$. The first switch element $Q_1$ may be a transistor or any other electrical element with the switch function.

In this embodiment, the first switch element $Q_1$ is an NPN transistor having a base B for receiving the speed detecting signal FG, a collector C electrically connected with the capacitor C through the diode $D_1$, and an emitter E that is grounded. In addition, one terminal of the resistor $R_1$ is electrically connected with the capacitor C, and the other terminal of the resistor $R_1$ is grounded.

The amplifier $U_1$ has a first input terminal $input_1$, a second input terminal $input_2$ and an output terminal output. The first input terminal $input_1$ is a noninverting input terminal, the second input terminal $input_2$ is an inverting input terminal, the first input terminal $input_1$ is electrically connected with the capacitor C, the second input terminal $input_2$ is electrically connected with one terminal of the resistor $R_2$, and the other terminal of the resistor $R_2$ is grounded. The second input terminal $input_2$ and the output terminal output are electrically connected with each other through the resistor $R_3$ to form a non-inverting amplifier.

In this embodiment, because the speed detecting signal FG is a PWM signal, the PWM signal is converted into a voltage signal according to the charging property of the capacitor C and the resistor $R_1$. Then, the amplifier $U_1$ amplifies the voltage signal to generate the corresponding speed signal $V_1$ for the subsequent circuit processing.

In this embodiment, the lower speed of the fan module 24 corresponds to the lower frequency of the PWM signal, and thus the higher corresponding speed signal $V_1$. On the contrary, the higher speed of the fan module 24 corresponds to the lower speed signal $V_1$.

The comparing unit 222 includes a comparator $U_2$, which has a first input terminal $input_1$, a second input terminal $input_2$ and an output terminal output. The first input terminal $input_1$ is a noninverting input terminal and the second input terminal $input_2$ is an inverting input terminal. The first input terminal $input_1$, which is electrically connected with the signal processing unit 221, receives the speed signal $V_1$. The second input terminal $input_2$ receives a reference signal $V_{ref}$, which is determined according to the actual requirement and serves as the reference value for judging whether the speed of the fan module 24 is too low.

The comparing unit 222 compares the speed signal $V_1$ with the reference signal $V_{ref}$. When the speed signal $V_1$ is higher than the reference signal $V_{ref}$, it is judged that the speed of the fan module 24 is too low. Then, the output terminal output generates a low speed signal $V_L$, which is a positive voltage level signal and serves as the alarm.

The logic device 23 includes a plurality of diodes $D_2$ and $D_3$, a second switch element $Q_2$ and a third switch element $Q_3$. Each of the second switch element $Q_2$ and the third switch element $Q_3$ may be a transistor or any other electrical element with the switch function. In this embodiment, the second switch element $Q_2$ is an NMOS transistor, and the third switch element $Q_3$ is an NPN transistor.

One drain D of the second switch element $Q_2$ is electrically connected with a base B of the third switch element $Q_3$. One source S of the second switch element $Q_2$ is grounded. One emitter E of the third switch element $Q_3$ is grounded. One collector C of the third switch element $Q_3$ is electrically connected with the electronic device 2 and outputs an alarm signal alarm. Herein, the alarm signal alarm is a high voltage level signal.

One terminal of the diode $D_2$, which is electrically connected with the second signal terminal $P_2$ of the drive device 21, receives the predetermined alarm signal RD. One terminal of the diode $D_3$, which is electrically connected with the comparing unit 222 of the speed detecting device 22, receives the low speed signal $V_L$. The other terminal of the diode $D_2$ is electrically connected with the other terminal of the diode $D_3$ to form an OR gate.

The other terminals of the diodes $D_2$ and $D_3$, which are electrically connected with a gate G of the second switch element $Q_2$, receive the predetermined speed alarm signal RD or the low speed signal $V_L$, and control the on/off states of the second switch element $Q_2$ and the third switch element $Q_3$ according to the predetermined speed alarm signal RD or the low speed signal $V_L$ so as to determine whether the alarm signal alarm has to be generated and outputted to the electronic device 2 to alarm the broken-down condition of the fan system 20.

The fan system 20 of this embodiment operates as follows. When the fan module 24 stops rotating, the drive device 21 detects the stop of the fan module 24 and outputs the predetermined alarm signal RD to the logic device 23 to turn on the diode $D_2$ and the second switch element $Q_2$, and to turn off the third switch element $Q_3$. At this time, the collector C of the third switch element $Q_3$ may output the alarm signal alarm to alarm that the fan system 20 has broken down.

However, when one fan of the fan module 24 has broken down, the broken-down fan is rotated by other fans (not shown). In this case, the drive device 21 cannot output the predetermined alarm signal RD.

At this time, the speed detecting device 22 receives the corresponding speed detecting signal FG, and the signal processing unit 221 processes the signal to generate the corresponding speed signal $V_1$ such that the comparing unit 222 can advantageously perform a comparison. Because the broken-down fan is rotated by other fans, the frequency of the corresponding speed detecting signal FG is very low. In this case, the speed signal $V_1$ is higher than the reference signal $V_{ref}$, and the comparing unit 222 generates the low speed signal $V_L$ and outputs the low speed signal $V_L$ to the logic device 23.

Next, the logic device 23 generates the alarm signal alarm according to the low speed signal $V_L$ and outputs the alarm signal to the electronic device 2 to alarm that the fan system 20 has broken down.

As mentioned hereinabove, the fan system 20 detects the speed of the fan module 24 and generates the alarm signal alarm when the speed of the fan module 24 is too low. Thus, it is possible to prevent the broken-down fan from being driven by other fans, and thus to avoid the error of the alarm signal alarm.

In addition, the fan system 20 of this embodiment may further include a Hall element 25 and a switch device 26. The Hall element 25 detects a position of a rotor of the fan module 24. The switch device 26 is electrically connected with the Hall element 25 and the logic device 23. When the switch device 26 receives the alarm signal alarm, the power of the Hall element 25 can be turned off such that the fan system 20 stops operating to achieve the effect of protection. In addition, the switch device 26 may also be directly electrically connected with the other terminals of the diodes $D_2$ and $D_3$. When the diodes $D_2$ and $D_3$ receive the predetermined speed alarm signal RD or the low speed signal $V_L$, the switch device 26 may be controlled to turn off the power of the Hall element 25 to achieve the effect of protection. Furthermore, the switch device 26 may be directly electrically connected with the speed detecting device 22. When the speed detecting device 22 outputs the low speed signal $V_L$, the switch device 26 turns off the power of the Hall element 25 to achieve the effect of protection.

Figure 4:
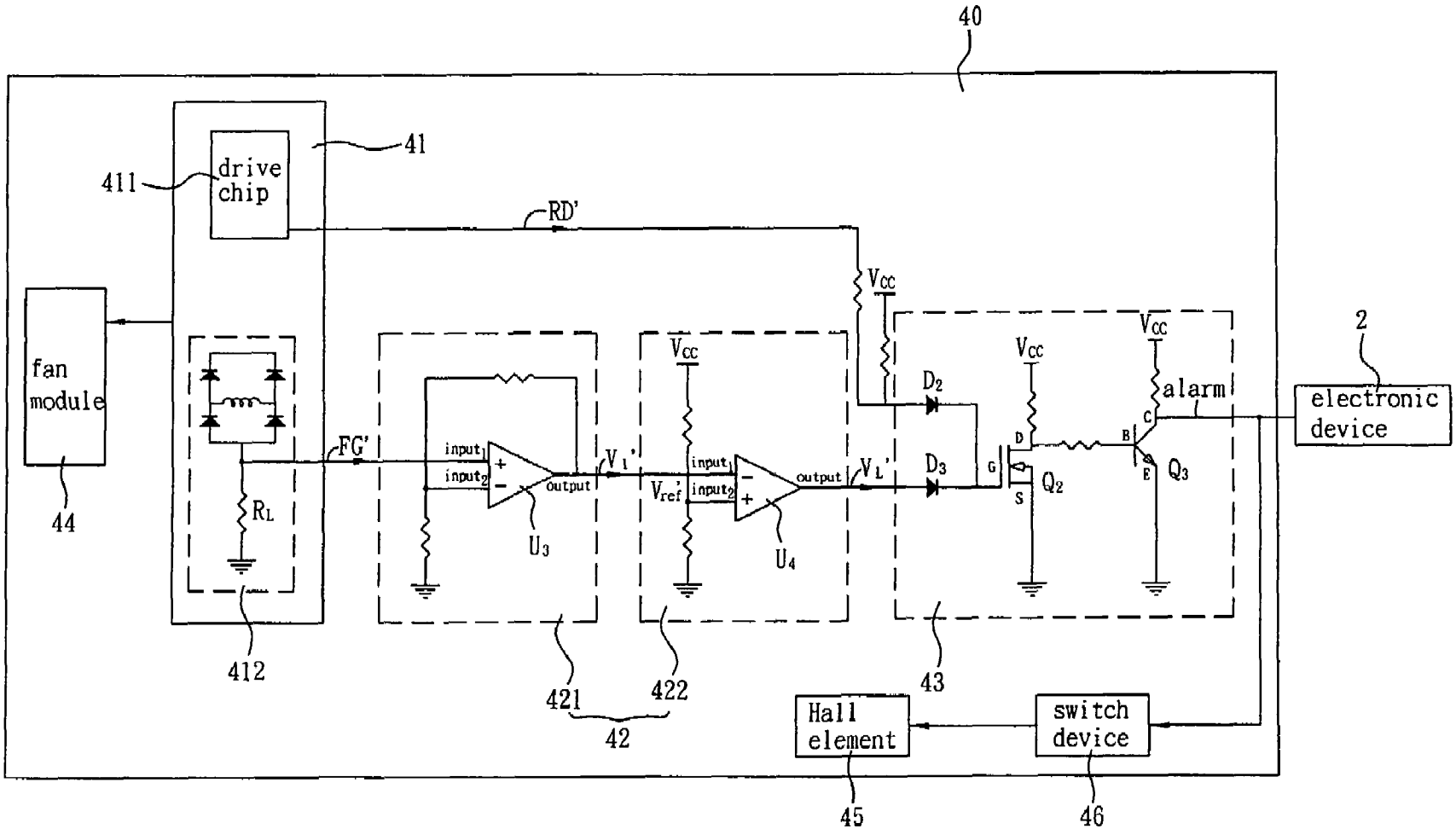
FIG. 4 is a circuit diagram showing a fan system according to another embodiment of the invention.

FIG. 4 is a circuit diagram showing a fan system 40 according to another embodiment of the invention. Referring to FIG. 4, the fan system 40 includes a drive device 41, a speed detecting device 42, a logic device 43 and a fan module 44. The logic device 43 and the fan module 44 are respectively the same as the logic device 23 and the fan module 24 of the above-mentioned embodiment in the aspects of construction and function, so detailed descriptions thereof will be omitted.

The drive device 41 of this embodiment includes a drive chip 411 and a bridge drive circuit 412. The drive chip 411 can output a predetermined alarm signal RD'. The bridge drive circuit 412 drives the fan module 44 to rotate to achieve the effect of heat dissipating. The bridge drive circuit 412 can provide a speed detecting signal FG'. In this embodiment, the bridge drive circuit 412 has a resistor $R_L$, and the speed detecting signal FG' is the voltage value across two terminals of the resistor $R_L$. Thus, when the speed of the fan module 44 decreases, the current flowing through the resistor $R_L$ decreases, and the voltage value of the speed detecting signal FG' decreases. On the contrary, when the speed of the fan module 44 increases, the current flowing through the resistor $R_L$ increases, and the voltage value of the speed detecting signal FG' increases.

The speed detecting device 42 includes a signal processing unit 421 and a comparing unit 422. The signal processing unit 421 includes an amplifier $U_3$ for amplifying the speed detecting signal FG' to generate a corresponding speed signal $V_1$'.

The comparing unit 422 includes a comparator $U_4$, which has a first input terminal $input_1$, a second input terminal $input_2$ and an output terminal output. The first input terminal $input_1$ is an inverting input terminal and the second input terminal $input_2$ is a noninverting input terminal. The second input terminal $input_2$ receives a reference signal $V_{ref}$' according to the actual requirement to serve as the reference value for judging whether the speed of the fan module 44 is too low. The first input terminal $input_1$, which is electrically connected with the signal processing unit 421, receives the speed signal $V_1$'.

The signal processing unit 421 amplifies the speed detecting signal FG' to generate the corresponding speed signal $V_1$'. The comparing unit 422 compares the speed signal $V_1$' with the reference signal $V_{ref}$'. When the speed signal $V_1$' is lower than the reference signal $V_{ref}$', the output terminal output generates a low speed signal $V_L$', which is a positive voltage level signal, and outputs the low speed signal $V_L$' to the logic device 43 for the subsequent operation of generating the alarm signal alarm. The operating principle thereof is the same as that described hereinabove, and detailed descriptions thereof will be omitted.

The fan system 40 of this embodiment may also include a switch device 46 and a Hall element 45, which are respectively the same as the switch device 26 and the Hall element 25 in the aspects of construction and function, and detailed descriptions thereof will be omitted.

In addition, the invention also discloses a speed detecting device, which is the same as the speed detecting device 22 or 42, and detailed descriptions thereof will be omitted.

In summary, the fan system and the speed detecting device thereof of the invention detect the speed of the fan and generate the alarm signal when the detected speed of the fan is too low, so as to prevent the broken-down fan from be driven by other fans, and to avoid the condition that the broken-down fan cannot be detected and the alarm signal cannot be outputted. Compared with the prior art, the invention detects the speed of the fan in order to detect the broken-down fan surely, and the desired alarm function can be achieved by the double confirmation.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan system comprising:

a drive device for generating the speed detecting signal and the predetermined alarm signal;

a speed detecting device for receiving the speed detecting signal and generating a low speed signal when the speed detecting signal is lower than a reference signal;

a logic device electrically connected with the speed detecting device for generating an alarm signal when receiving the low speed signal or the predetermined alarm signal;

a Hall element; and a switch device electrically connected with the Hall element and the speed detecting device for turning off the Hall element when the switch device receives the low speed signal.

2. The fan system according to claim 1, wherein the speed detecting device comprises:

a signal processing unit for receiving the speed detecting signal and generating a corresponding speed signal according to the speed detecting signal; and a comparing unit electrically connected with the signal processing unit for comparing the speed signal with the reference signal and generating the low speed signal when the speed signal is lower than the reference signal.

3. The fan system according to claim 2, wherein the signal processing unit comprises an amplifier for receiving the speed detecting signal and converting the speed detecting signal into the corresponding speed signal.

4. The fan system according to claim 3, wherein the signal processing unit comprises:

a first switch element for receiving the speed detecting signal; and a capacitor electrically connected with the first switch element and the amplifier, wherein the speed detecting signal is converted into the speed signal by the first switch element, the capacitor and the amplifier.

5. The fan system according to claim 4, wherein the first switch element is an NPN transistor having a base for receiving the speed detecting signal, a collector electrically connected with the capacitor, and an emitter grounded.

6. The fan system according to claim 2, wherein the comparing unit is a comparator having a first input terminal for receiving the speed signal, a second input terminal for receiving the reference signal, and an output terminal for generating the low speed signal.

7. The fan system according to claim 1, wherein the logic device comprises:

a first diode having one terminal for receiving the predetermined alarm signal; and a second diode having one terminal electrically connected with the speed detecting device to receive the low speed signal, wherein the other terminal of the first diode is electrically connected with the other terminal of the second diode, and outputs the predetermined alarm signal or the low speed signal.

8. The fan system according to claim 7, wherein the speed detecting device comprises a signal processing unit for receiving the speed detecting signal and generating a corresponding speed signal according to the speed detecting signal, the signal processing unit comprises a first switch element for receiving the speed detecting signal, and the logic device further comprises:

a second switch element electrically connected with the other terminals of the first diode and the second diode for receiving the predetermined alarm signal or the low speed signal; and a third switch element electrically connected with the second switch element for generating the alarm signal according to the predetermined alarm signal or the low speed signal.

9. The fan system according to claim 8, wherein each of the second switch element and the third switch element is a transistor.

10. The fan system according to claim 1, further comprising a fan module having at least one fan.

11. The fan system according to claim 1, wherein the drive device is a drive chip or a bridge drive circuit.

12. The fan system according to claim 11, wherein the bridge drive circuit has a resistor, and the speed detecting signal is a voltage value across two terminals of the resistor.

13. A speed detecting device of a fan system for receiving a speed detecting signal, comprising:

a signal processing unit for receiving the speed detecting signal and generating a corresponding speed signal according to the speed detecting signal, wherein the signal processing unit comprises a first switch element and a capacitor, the first switch element is for receiving the speed detecting signal, and the capacitor is electrically connected with the first switch element; and a comparing unit electrically connected with the signal processing unit for comparing the speed signal with a reference signal, generating a low speed signal when the speed signal is lower than the reference signal, and thus generating an alarm signal.

14. The speed detecting device according to claim 13, wherein the signal processing unit comprises an amplifier for receiving the speed detecting signal and converting the speed detecting signal into the corresponding speed signal.

15. The speed detecting device according to claim 14, wherein the capacitor is electrically connected with the amplifier, and the speed detecting signal is converted into the speed signal by the first switch element, the capacitor and the amplifier.

16. The speed detecting device according to claim 15, wherein the first switch element is an NPN transistor having a base for receiving the speed detecting signal, a collector electrically connected with the capacitor, and an emitter grounded.

17. The speed detecting device according to claim 13, wherein the comparing unit is a comparator having a first input terminal for receiving the speed signal, a second input terminal for receiving the reference signal, and an output terminal for generating the low speed signal.

* * * * *